US010126079B2

(12) United States Patent
Voigt

(10) Patent No.: US 10,126,079 B2
(45) Date of Patent: Nov. 13, 2018

(54) FOLDING POCKET PISTOL

(71) Applicant: Aaron Voigt, Asheville, NC (US)

(72) Inventor: Aaron Voigt, Asheville, NC (US)

( * ) Notice: Subject to any disclaimer, the term of this patent is extended or adjusted under 35 U.S.C. 154(b) by 0 days.

(21) Appl. No.: 15/660,894

(22) Filed: Jul. 26, 2017

(65) Prior Publication Data

US 2017/0321981 A1 Nov. 9, 2017

Related U.S. Application Data

(63) Continuation-in-part of application No. 15/350,705, filed on Nov. 14, 2016.

(60) Provisional application No. 62/253,990, filed on Nov. 11, 2015.

(51) Int. Cl.

| | |
|---|---|
| ***F41A 11/04*** | (2006.01) |
| ***F41C 3/00*** | (2006.01) |
| ***F41A 3/06*** | (2006.01) |
| ***F41C 9/02*** | (2006.01) |
| ***F41A 3/58*** | (2006.01) |
| ***F41A 3/66*** | (2006.01) |
| ***F41A 17/46*** | (2006.01) |
| ***F41A 19/13*** | (2006.01) |
| ***F41A 19/26*** | (2006.01) |
| ***F41C 23/22*** | (2006.01) |

(52) U.S. Cl.

CPC ..... *F41A 11/04* (2013.01); *F41A 3/06* (2013.01); *F41A 3/58* (2013.01); *F41A 3/66* (2013.01); *F41A 17/46* (2013.01); *F41A 19/13* (2013.01); *F41A 19/26* (2013.01); *F41C 3/00* (2013.01); *F41C 9/02* (2013.01); *F41C 23/22* (2013.01)

(58) Field of Classification Search

CPC ..... F41A 11/04; F41A 19/39; F41C 23/04; F41C 23/12; F41C 7/11

USPC ..... 42/71.01, 72, 75.04, 73, 75.03

See application file for complete search history.

(56) References Cited

U.S. PATENT DOCUMENTS

| | | | | |
|---|---|---|---|---|
| 53,473 | A | 3/1866 | Peavey | |
| 521,202 | A * | 6/1894 | Burgess | F41C 23/16 42/71.01 |
| 562,487 | A * | 6/1896 | Quackenbush | F41C 23/04 42/72 |
| 626,472 | A | 6/1899 | White | |
| 652,583 | A * | 6/1900 | Baird | F41C 7/11 42/71.01 |
| 1,515,751 | A | 11/1924 | Polhemus | |

(Continued)

*Primary Examiner* — Michael D David

(74) *Attorney, Agent, or Firm* — Bennet K Langlotz; Langlotz Patent & Trademark Works, Inc.

(57) ABSTRACT

A folding pocket pistol has a frame, a barrel connected to the frame and defining a bore and a chamber and movable between an operating position and a loading position, a bolt connected to the frame and operable to reciprocate between a rearward cocked position and a forward battery position, a trigger connected to the frame and having a lever movable between a forward position and a rearward position, a grip connected to the frame and movable between a closed position abutting the frame, and an open position away from the frame, the grip defining a pocket adapted to receive the trigger lever when the trigger lever is in the forward position, and the grip having a pocket block surface adapted to contact a portion of the trigger lever when the trigger lever is in the rearward position, which prevents the grip moving to the closed position.

20 Claims, 5 Drawing Sheets

(56) References Cited

U.S. PATENT DOCUMENTS

| | | | | | |
|---|---|---|---|---|---|
| 1,588,887 | A * | 6/1926 | Haubroe | F41A 11/04 | 42/75.03 |
| 3,020,662 | A * | 2/1962 | Merkel | F41A 3/18 | 42/11 |
| 3,341,964 | A | 9/1967 | Ryan et al. | | |
| 3,861,273 | A * | 1/1975 | Seidel | F41A 9/62 | 89/129.02 |
| 4,271,623 | A * | 6/1981 | Beretta | F41C 23/12 | 42/71.02 |
| 4,299,046 | A * | 11/1981 | Atchisson | F41A 9/72 | 42/40 |
| 4,625,621 | A * | 12/1986 | Warin | F41C 9/02 | 42/1.09 |
| D400,632 | S | 11/1998 | Powell | | |
| 6,209,250 | B1 | 4/2001 | Mills | | |
| 7,322,142 | B1 * | 1/2008 | Leung | F41C 23/04 | 42/71.01 |
| 7,941,954 | B2 * | 5/2011 | Carr | F41A 11/04 | 42/36 |
| 9,273,927 | B2 * | 3/2016 | Bondhus | F41C 3/00 | |
| 2011/0072705 | A1 | 3/2011 | Simpkins | | |
| 2014/0352190 | A1 * | 12/2014 | Voigt | F41C 23/14 | 42/73 |

* cited by examiner

FOLDING POCKET PISTOL

REFERENCE TO RELATED APPLICATION

This application is a Continuation-in-Part of U.S. patent application Ser. No. 15/350,705, entitled "FOLDING POCKET PISTOL," filed Nov. 14, 2016, which claims priority to U.S. Provisional Application Ser. No. 62/253,990 filed Nov. 11, 2015, and entitled, "FOLDING POCKET PISTOL."

FIELD OF THE INVENTION

The present invention relates to firearms, and more particularly to a pistol that folds into a compact shape for storage or transport without resembling a firearm.

BACKGROUND OF THE INVENTION

A pocket pistol is any compact, pocket-sized handgun, suitable for concealed carry in either a pants pocket or a coat pocket. Concealed carry is the practice of carrying a firearm, usually a handgun, in public in a concealed manner. Conventional pocket pistols are often carried in a pocket holster to prevent inadvertent discharge while being carried. While some of these holsters attempt to address the easily identifiable silhouette of a pocket carry firearm in a carrier's pocket, the shape of the firearm is no longer concealed once the firearm is drawn. Furthermore, a conventional handgun shape can also be difficult to draw smoothly from a pocket and often turn pockets inside out, which causes snagging when the firearm is drawn.

Therefore, a need exists for a new and improved folding pocket pistol that is easily carried and stored without resembling a firearm. In this regard, the various embodiments of the present invention substantially fulfill at least some of these needs. In this respect, the folding pocket pistol according to the present invention substantially departs from the conventional concepts and designs of the prior art, and in doing so provides an apparatus primarily developed for the purpose of being easily carried and stored without resembling a firearm.

SUMMARY OF THE INVENTION

The present invention provides an improved folding pocket pistol, and overcomes the above-mentioned disadvantages and drawbacks of the prior art. As such, the general purpose of the present invention, which will be described subsequently in greater detail, is to provide an improved folding pocket pistol that has all the advantages of the prior art mentioned above.

To attain this, the preferred embodiment of the present invention essentially comprises a frame, a barrel connected to the frame and defining a bore and a chamber and movable between an operating position and a loading position, a bolt connected to the frame and operable to reciprocate between a rearward cocked position and a forward battery position, a trigger connected to the frame and having a lever movable between a forward position and a rearward position, a grip connected to the frame and movable between a closed position abutting the frame, and an open position away from the frame, the grip defining a pocket adapted to receive the trigger lever when the trigger lever is in the forward position, and the grip having a pocket block surface adapted to contact a portion of the trigger lever when the trigger lever is in the rearward position thereby to prevent the grip moving to the closed position when the trigger lever is in the rearward position. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
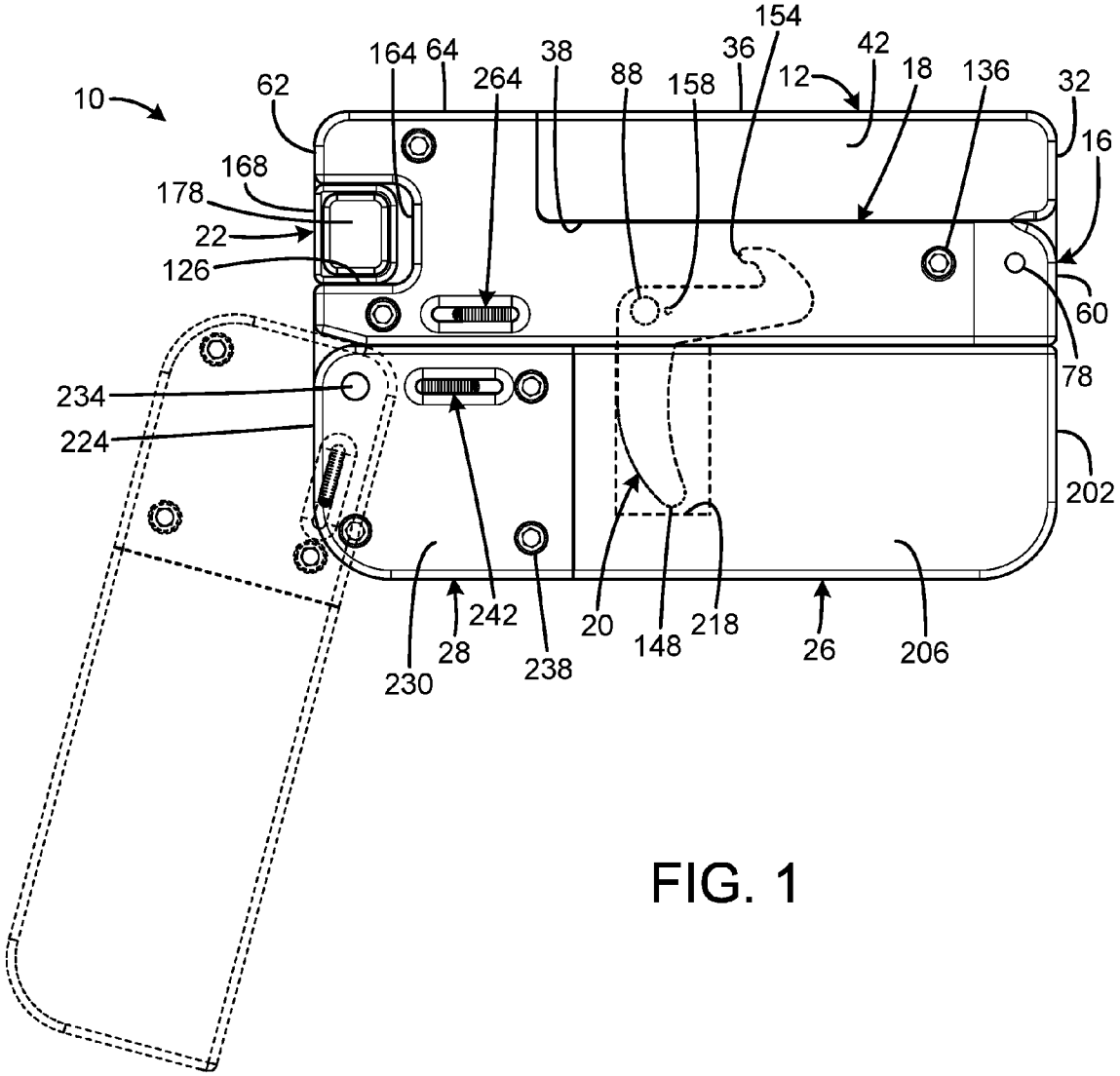
FIG. 1 is a right side view of the current embodiment of a folding pocket pistol constructed in accordance with the principles of the present invention with the pistol in the half-cocked condition.

An embodiment of the folding pocket pistol of the present invention is shown and generally designated by the reference numeral 10.

Figure 2:
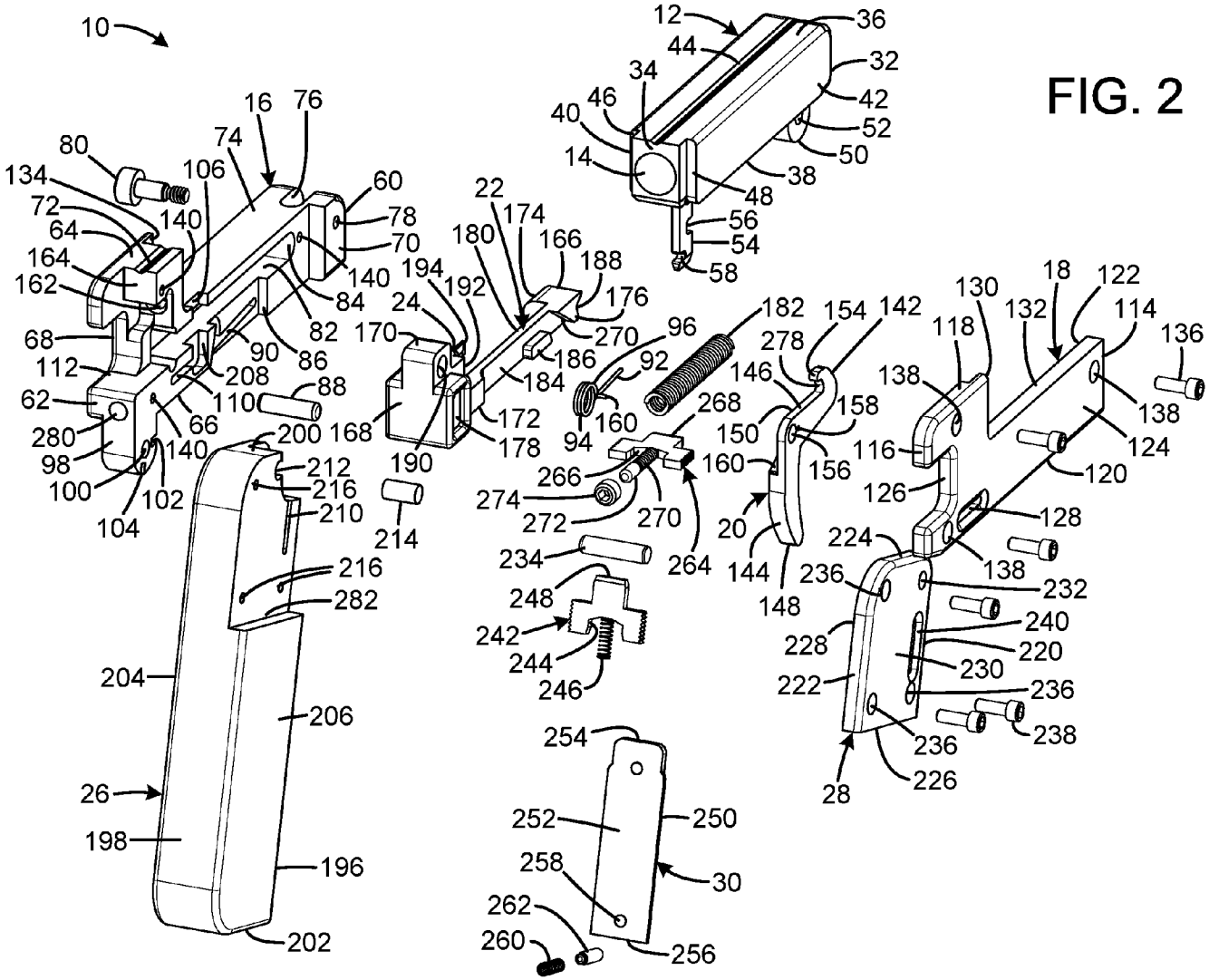
FIG. 2 is an exploded view of the folding pocket pistol of the present invention.

FIGS. 1 and 2 illustrate the improved folding pocket pistol 10 of the present invention. More particularly, the folding pocket pistol is shown in the half-cocked/safe condition in FIG. 1. The folding pocket pistol has a barrel 12 with a central bore 14, a frame 16, a frame side plate 18, a trigger 20, a bolt 22 with a firing pin 24, a handle/grip 26, a handle side plate 28, and a storage cap 30. In the current embodiment, the folding pocket pistol defines a rectangular periphery when in the folded/closed position that is 2.125 inches high, 3.375 inches wide, and 0.500 inches thick. The width and height of the folding pocket pistol are essentially the same as those of a standard debit or credit card, which makes it possible to carry the folding pocket pistol in a wallet of sufficient thickness. With the handle in the unfolded condition denoted by the dashed lines in FIG. 1, the folding pocket pistol assumes a more traditional pistol shape and size for ease of operation. In the current embodiment, the barrel, bolt, and trigger are made of steel, and the frame, frame side plate, handle, handle side plate, and storage cap are made of aluminum.

The barrel 12 has a front 32, rear 34, top 36, bottom 38, left 40, and right 42. The barrel has a central bore 14 that opens at both the front and the rear of the barrel. The top of the barrel forms a sight notch 44 that is used to aim the folding pocket pistol 10. The rear of the barrel forms a left notch 46 and a right notch 48. The left and right sides of the barrel are planar. The bottom front of the barrel forms a downwardly protruding lug 50 with an aperture 52. The bottom rear of the barrel forms a downward engagement element/protrusion 54 having an upper front slot 56 and a lower rear slot 58. In the current embodiment, the folding pocket pistol is chambered for .22 caliber rimfire cartridges in short, long, or long rifle variety. The pistol is sized properly to also fire 0.22 WMR, 0.17 HMR and 0.17 Mach 2 with only a change in the chamber. Accessory barrels in any of these other calibers could be made and switched out on what would otherwise be an unchanged folding pocket pistol.

The frame 16 has a front 60, rear 62, top 64, bottom 66, left 68, and right 70. The top rear of the frame forms a sight notch 72 that is used to aim the folding firearm 10. The remainder of the top of the pistol frame forms a slot 74, and the forwardmost portion of slot 74 forms a slot 76. Apertures in the left and right sides of the front of the pistol frame (only aperture 78 is visible) communicate with the slot 50. The slot 74 has a width that corresponds to the width of the barrel 12, and the slot 76 has a width that enables the lug 50 of the barrel to be closely received therein. The barrel is pivotally attached to the frame by a barrel screw 80 that is received by the apertures in the left and right sides of the pistol frame and aperture 52 in the lug of the barrel. The slot 74 is flush with the bottom 38 of the barrel when the barrel is attached to the frame.

The left side 68 of the frame 16 is essentially a planar surface. The right side 70 forms a bolt slot 82 that extends from the rear 62 of the pistol frame and terminates at a forwardmost location 84. The bottom 66 of the pistol frame forms a trigger slot 86 that receives one end of a trigger pivot pin 88 that extends to the right. A trigger pin slot 90 is defined within the trigger slot. The trigger slot is shaped to receive a front portion 92 and coil portion 94 of a trigger spring 96. The bottom rear of the pistol frame forms a lug 98 with an aperture 100. The lug defines a front slot 102 and a bottom slot 104. A notch 106 located above the bolt slot is vertically aligned with a notch 208 located below the bolt slot. A barrel latch slot 110 is in communication with notch 208. The left rear of the frame forms a slot 112. The top left rear of the frame includes a forward-facing flange 134 adjacent to slot 74. The flange is received within the left notch 46 of the barrel 12 when the barrel is installed in the slot 74. The rear of the frame defines an aperture 162 that is in communication with the rear 34 of the central bore 14 of the barrel 12 when the barrel is installed in the frame. The rear of the frame has a stop surface 164 located immediately above the aperture 162.

The frame side plate 18 has a front 114, rear 116, top 118, bottom 120, left 122, and right 124. The rear of the frame side plate forms a slot 126 that matches slot 112 in the frame 16. The bottom rear portion of the frame side plate defines a barrel latch slot 128 that is registered with the barrel latch slot 110 in the frame when the frame side plate is attached to the frame. The left, right, and bottom of the frame side plate are planar surfaces. The top rear of the frame side plate includes a forward-facing flange 130 that is received within the right notch 48 of the barrel 12 when the frame side plate is attached to the frame. The remainder of the top of the frame side plate in front of the flange forms a slot 132 that is flush with the bottom 38 of the barrel when the frame side plate is attached to the frame. Three frame side plate screws 136 are received in apertures 138 in the frame side plate and are threadedly engaged with threaded apertures 140 in the right side 70 of the frame to secure the frame side plate to the right side of the frame.

The trigger 20 has a front 142, rear 144, top 146, bottom 148, left 150, and right 152. The bottom of the trigger is rounded, and the front of the trigger forms a concave depression to receive a user's finger for trigger operation. The top front of the trigger forms a hook 154. The top rear of the trigger has an aperture 156 that receives the trigger pivot pin 88 when the trigger is installed in the trigger slot 86 of the frame 16. The top rear of the trigger also has a small aperture 158 immediately in front of aperture 156 that receives a right-protruding portion 160 of the trigger spring 96. The left side of the trigger defines a slot 160 to provide clearance for the top of the trigger to pivot about the trigger pivot pin within the trigger slot of the frame.

The bolt 22 is an elongated body having a front 166, rear 168, top 170, bottom 172, left 174, and right 176. The rears of the right and left sides of the bolt have recesses 178 that facilitate the drawing back of the bolt by the user by enabling the user to easily pinch the rear of the bolt between a thumb and forefinger. The slot 112 in the rear 62 of the frame 16 and the slot 126 in the rear of the frame side plate 18 are sized to closely receive the recessed portions of the left and right sides of the bolt. The remainder of the front left side of the bolt forms a slot 180. The left front of the bolt is shaped to reciprocate within the bolt slot 82 in the frame. A mainspring 182 is received within the slot 180. The mainspring is captured between the forwardmost portion of the bolt slot 180 and the rearwardmost portion of the bolt slot 82 in the frame 16. The remainder of the front right side of the bolt immediately behind the front of the bolt forms a notch 184. A block element/boss 186 is positioned within the notch 184. The front of the bolt is notched to form a sear 188 having an engagement surface, and the rear of the sear has an angled ramp 270. The top rear of the bolt defines a padlock aperture 190. When a padlock is locked through the padlock aperture, forward movement of the bolt within the frame is constrained such that the folding pocket pistol 10 cannot be discharged even when the bolt is cocked. A vertical stop surface 192 is located immediately in front of the padlock aperture. The stop surface 192 contacts the stop surface 164 of the frame to constrain forward movement of the bolt when the folding pocket pistol is discharged.

The top rear of the bolt 22 includes a firing pin 24. The firing pin has a tapered front 194. The tapered front is axially registered with the aperture 162 in the frame 16 when the bolt is installed in the frame. When the tapered front strikes the rear of a round of ammunition (not shown) chambered in the central bore 14 of the barrel 12, the impact causes the folding pocket pistol 10 to fire.

The handle 26 has a front 196, rear 198, top 200, bottom 202, left 204, and right 206. The left side of the handle is planar. The right side of the handle is also largely planar except for a slot 282 in the top right. A slot 210 that is parallel to the front of the handle is formed within the slot 282. A handle bumper slot 212 is formed above the slot 210. The handle bumper slot receives a handle bumper 214, which is a rubber cylinder in the current embodiment. Three threaded apertures 216 are defined within the slot 208. The front of the handle below the slot 208 defines a trigger pocket 218 (shown as dashed lines in FIG. 1). The trigger pocket is shaped to closely conform to the bottom 148 of the trigger 20. In the folded condition, the bottom 148 of the trigger 20 is closely received within the trigger pocket 218 to prevent trigger movement. The trigger is entirely enclosed by the frame and the trigger pocket when the folding pocket pistol 10 is in the closed/folded position. A pocket block surface 276 on the rear edge of the trigger pocket prevents the handle from being closed when the trigger is not in the forward position/safe condition. When the trigger is in an intermediate position between the forward and rearward position, or in the rearward position, the pocket block surface contacts the trigger to prevent the handle from closing. The front of the handle and the front 220 of the handle side plate 28 abut/fit flush against the bottom 120 of the frame side plate 18 and the bottom 66 of the frame 16 in the folded condition/closed position. The handle and frame are each elongated elements that are parallel to each other when in the closed position and angularly disposed with each other when in the open position.

The handle side plate 28 has a front 220, a rear 222, a top 224, a bottom 226, a left 228, and a right 230. The top front of the handle side plate defines a handle pivot pin aperture 232 that receives a handle pivot pin 234. The handle pivot pin extends through the top 200 front 196 of the handle 26 and the aperture 100 in the lug 98 of the frame 16 to pivotally attach the handle to the frame. The top rear and bottom front and rear of the handle side plate define three screw apertures 236 that receive handle side plate screws 238. The screw apertures are axially registered with the threaded apertures 216 in the right side of the handle so the handle side plate screws can secure the handle side plate to the right side of the handle within slot 208. A handle latch slot 240 is defined in the front of the handle side plate between the handle pivot pin aperture and the bottom front screw aperture. The handle latch slot is axially registered with the slot 210 in the handle.

A handle latch tab 242 is received within the handle latch slot 240 and the slot 210 in the handle 26. The handle latch tab is generally Y-shaped in the current embodiment with a rear slot 244 and a wedge-shaped front 248. A handle latch tab spring 246 is received within the rear slot to bias the handle latch tab forward within the handle latch slot and the slot 210 in the handle. The front of the handle latch tab is received within the front slot 102 in the lug 98 of the frame 16 to releasably secure the handle in the folded position. The front of the handle latch tab is received within the bottom slot 104 in the lug of the frame to releasably secure the handle in the unfolded position. The handle bumper 214 provides a cushion between the top 200 front 196 of the handle and the rear 62 of the frame and limits the pivotal movement of the handle relative to the frame.

A storage cap 30 has a front 250, rear 252, top 254, and bottom 256. The storage cap defines apertures 258 at the top and bottom. A storage cap detent pin 262 is biased by a storage cap spring 260. The storage cap has thinned edges that are received into matching slots (not visible) in the handle. The storage cap slides back and forth to the closed and open positions where the storage cap is stopped by the detent pin. There is a small recess slot (not visible) on the front of the cap that allows a fingertip or nail to catch and operate the storage cap.

A barrel latch tab 264 is received within the barrel latch slot 128 in the frame side plate 18 and the slot 110 in the frame 16. The barrel latch tab is generally Y-shaped in the current embodiment with a rear slot 266 and a wedge-shaped front 268. A barrel latch tab spring 270 is received within the rear slot to bias the barrel latch tab forward within the barrel latch slot and the barrel latch slot 128 in the frame side plate. A barrel latch tab spring pin 272 is used to set the position of the barrel latch tab spring, and a set screw 274 serves as a dust cover in the frame hole 280. The set screw is installed into aperture 280 in the frame. The front of the barrel latch tab is received within the rear slot 58 in the protrusion 54 of the barrel 12 to releasably secure the rear 34 of the barrel to the frame.

Figure 3:
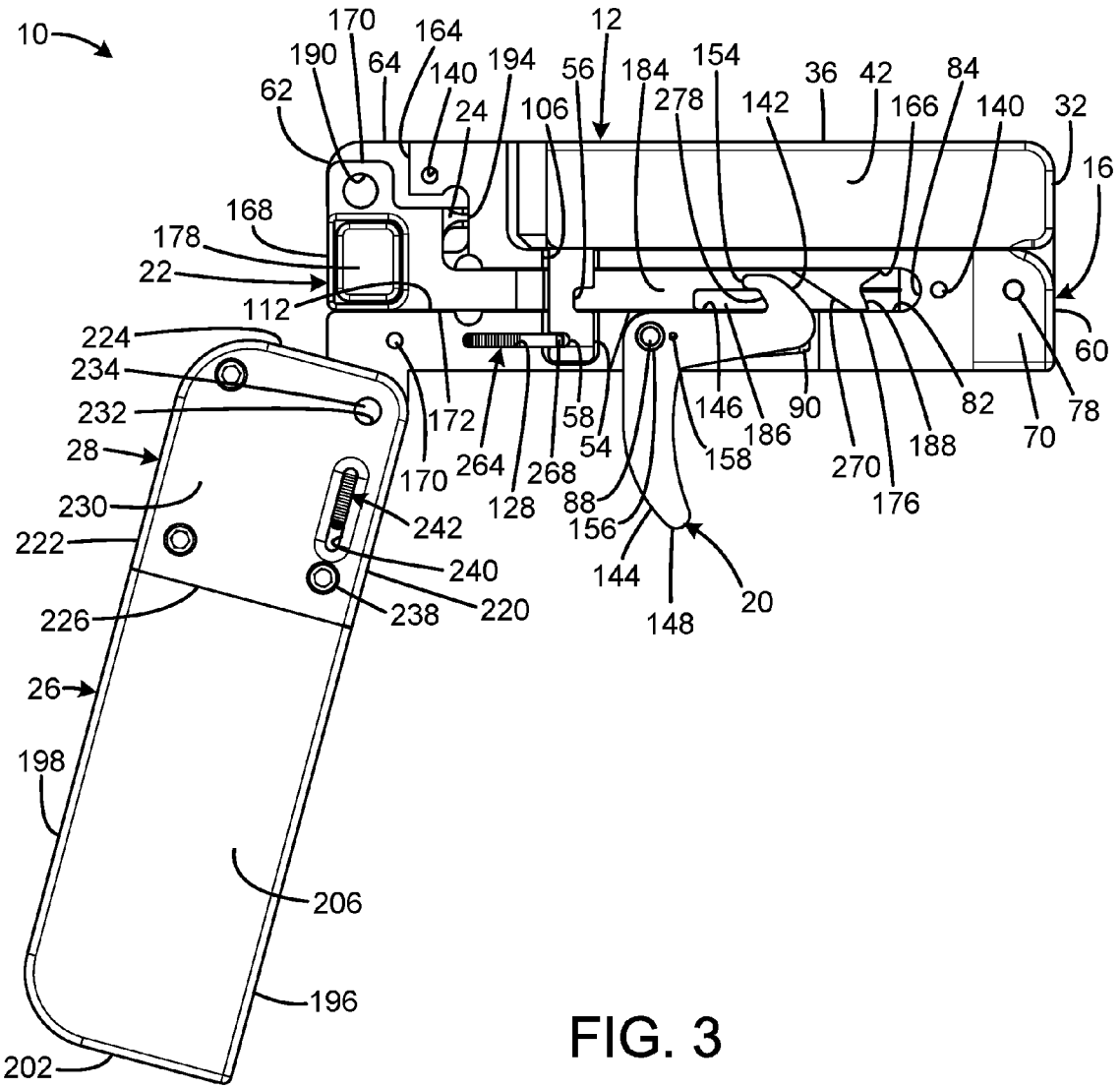
FIG. 3 is a right side view of the folding pocket pistol of the present invention in the half-cocked condition with the frame side plate cutaway.
Figure 4:
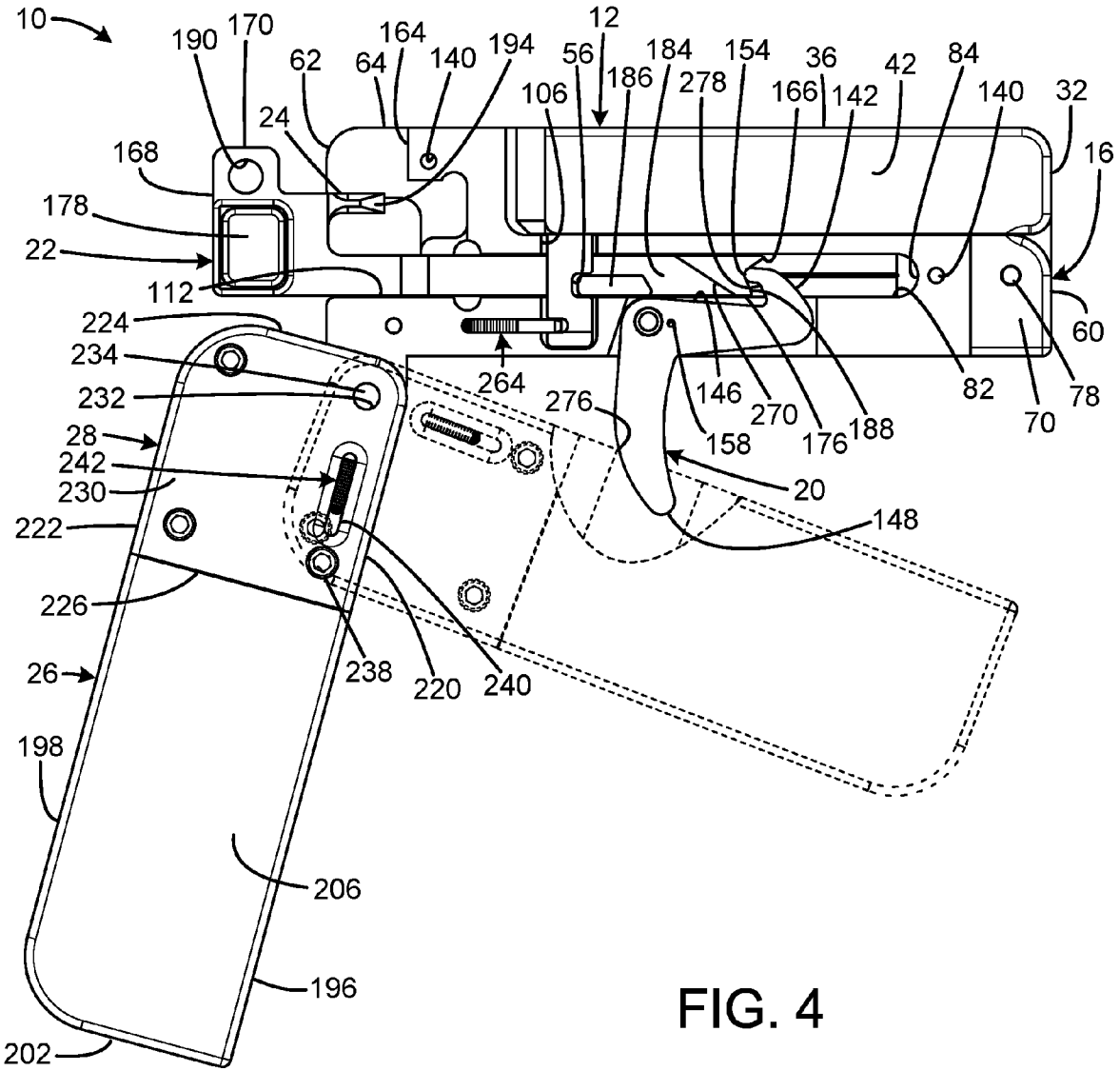
FIG. 4 is a right side view of the folding pocket pistol of the present invention in the ready to fire condition with the frame side plate cutaway.
Figure 5:
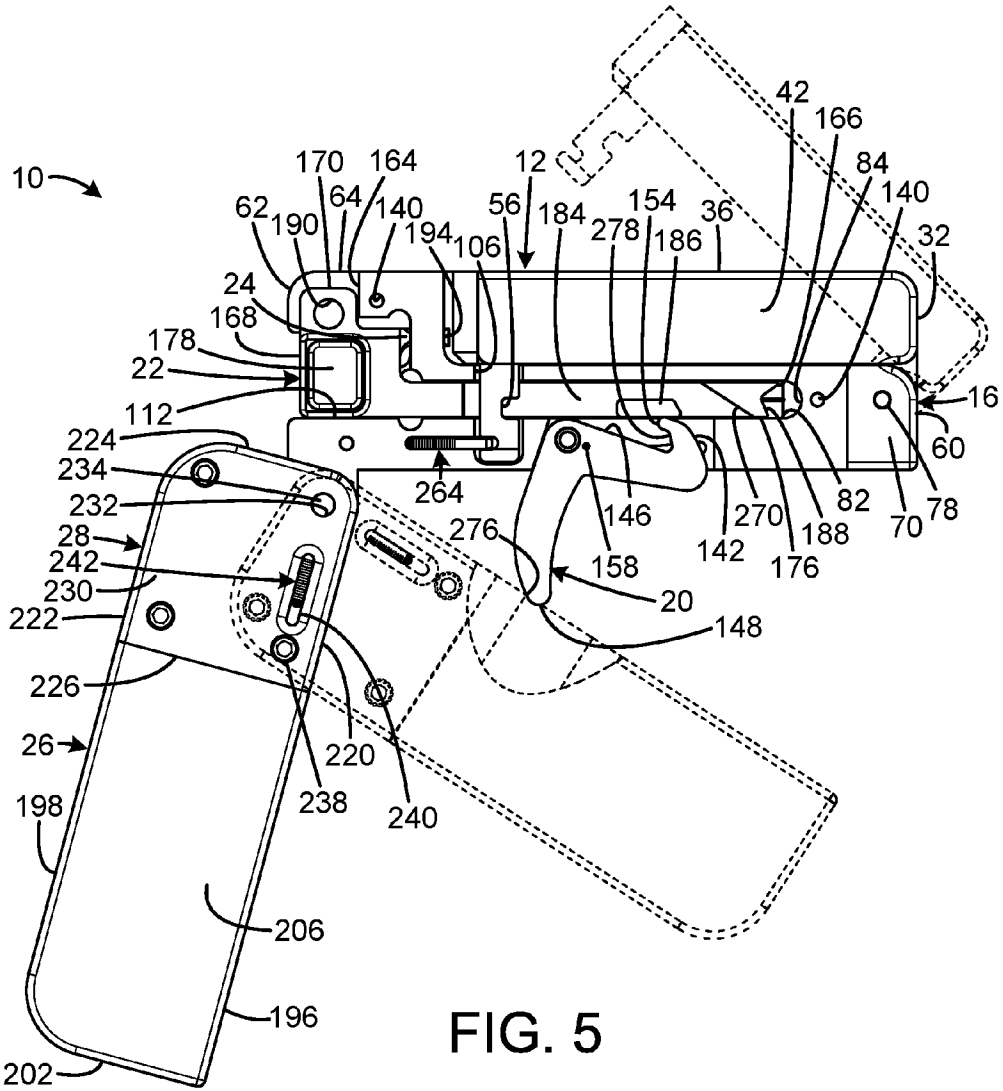
FIG. 5 is a right side view of the folding pocket pistol of the present invention in the after firing condition with the frame side plate cutaway.

FIGS. 3-5 illustrate the firing and loading procedures for the folding pocket pistol 10 of the present invention. More particularly, FIG. 3 shows the positions of the bolt 22 and trigger 20 when the folding firearm is in the half-cocked/safe condition/home position. The catch element/boss 186 on the bolt 22 is received by a pocket 278 beneath the hook 154 of the trigger, which prevents the trigger from moving from the forward position even if the trigger is pulled, except upon rearward movement of the bolt toward the cocked position when the boss is withdrawn from the hook pocket. The engagement of the boss with the trigger also prevents the bolt from moving forward to enable the firing pin 24 to contact a loaded cartridge (not shown). In this condition, the handle 26 can be folded and unfolded. When the handle is folded, the bolt cannot be cocked because the trigger is captured by the trigger pocket 218. As a result, the trigger cannot cam clockwise when in contact with the angled ramp 270 to let the sear 188 engage the hook 154 of the trigger when the trigger spring 96 snaps the trigger counterclockwise when the trigger no longer contacts the bottom 172 of the front 166 of the bolt. When the handle is unfolded into an open position away from the frame 16, the bolt can be cocked because the trigger is free to cam clockwise when contacted by the angled ramp. The barrel can be tipped up for loading (the position shown by dashed lines in FIG. 5) when the barrel latch tab 264 is pulled back sufficiently to withdraw the front 268 of the barrel latch tab from the rear slot 58 in the protrusion 54 of the barrel regardless of the position of the handle. The barrel pivots clockwise about barrel screw 80 to expose the rear 34 of the barrel so a round of ammunition can be loaded into the central bore 14. The barrel is then pivoted counterclockwise to return the protrusion 54 to the notches 106 and 108 in the frame so the front of the barrel latch tab can be received within the rear slot in the protrusion to releasably secure the rear of the barrel to the frame in the operating position. The handle is held in the folded or unfolded position by the handle latch tab 242, which must be pulled toward the bottom 202 of the handle to disengage the front 248 of the handle latch tab from the front slot 102 or bottom slot 104 in the lug 98 of the frame 16 to transition the handle between the folded and unfolded positions.

FIG. 4 shows the positions of the bolt 22 and trigger 20 when the folding pocket pistol 10 is in the ready to fire/cocked condition. The bolt has been pulled rearward relative to the frame 16 into the rearward cocked position. The mainspring 182 urges the bolt forward, but forward movement of the bolt is prevented by the engagement of the hook 154 of the trigger in the intermediate position with the sear 188 on the front 166 of the bolt. As is denoted by the dashed lines, the handle cannot be folded in the cocked condition because the trigger pocket 218 cannot receive the trigger when the trigger is in the cocked position. The barrel cannot be tipped up for loading even when the barrel latch tab 264 is pulled back sufficiently to withdraw the front 268 of the barrel latch tab from the rear slot 58 in the protrusion 54 of the barrel because the boss 186 is received within the front slot 56 in the protrusion of the barrel and serves as a barrel lock element. The folding pocket pistol can be discharged by pulling the trigger in this condition. Alternatively, to uncock the folding pocket pistol, the user can pull the bolt slightly rearward, pulling and then releasing the trigger while continuing to hold the bolt, and then slowly returning the bolt forward to the half-cocked/safe condition where the boss is received by the hook 154 of the trigger, which prevents the bolt from moving forward to enable the firing pin 24 to contact a loaded cartridge (not shown).

FIG. 5 shows the positions of the bolt 22 and trigger 20 immediately after the folding pocket pistol 10 has discharged. The hook 154 of the trigger has been pulled to pivot the trigger clockwise and downwards such that forward movement of the bolt is only limited by the contact of the stop surface 192 of the bolt with the stop surface 164 of the frame 16. The bolt moves to the forward battery position and urges the front tapered portion 194 of the firing pin 24 forward, resulting in a sharp impact upon the round of ammunition (not shown) and the discharge of the folding firearm. There is no interference of the firing pin with the chamber/barrel breech portion of the central bore 14 of the barrel 12. This allows for "dry firing" of the folding pocket pistol 10 with no harm whatsoever. As is denoted by the dashed lines, the handle 26 cannot be folded in the discharged condition because the trigger pocket 218 cannot receive the trigger when the trigger is in the rearward, discharged position. The boss 186 holds the trigger in the pulled/rearward position. The barrel can be tipped up to the loading position as denoted by the dashed lines when the barrel latch tab 264 is pulled back sufficiently to withdraw the front 268 of the barrel latch tab from the rear slot 58 in the protrusion 54 of the barrel because the boss is not received within the front slot 56 in the protrusion of the barrel. Once a new cartridge is loaded, the bolt must be retracted slightly rearward to position shown in FIG. 3 to return the folding pocket pistol to the half-cocked/safe condition to permit the barrel to be closed. Otherwise, the exposed firing pin will interfere with the new cartridge and prevent the barrel from closing. The half-cocked/safe condition also permits the handle to be folded. Subsequently, the bolt can be fully retracted to the position shown in FIG. 4 to return the folding pocket pistol to the ready to fire/cocked condition.

In the context of the specification, the terms "rear" and "rearward" and "front" and "forward" have the following definitions: "rear" or "rearward" means in the direction away from the muzzle of the firearm, while "front" or "forward" means in the direction towards the muzzle of the firearm.

While a current embodiment of a folding pocket pistol has been described in detail, it should be apparent that modifications and variations thereto are possible, all of which fall within the true spirit and scope of the invention.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A pistol comprising:

a frame;

a barrel connected to the frame and defining a bore and a chamber and movable between an operating position and a loading position;

a bolt connected to the frame and operable to reciprocate between a rearward cocked position and a forward battery position;

a trigger connected to the frame and having a trigger lever movable between a forward position and a rearward position;

a grip pivotally connected to the frame by way of a pivot element and the grip being pivotally between a closed position abutting the frame, and an open position away from the frame;

the grip defining a pocket adapted to receive the trigger lever when the trigger lever is in the forward position;

the grip having a pocket block surface spaced apart from the pivot element by a first distance;

the trigger having a contact surface spaced apart from the pivot element by a second distance less than the first distance when the trigger lever is in the rearward position thereby to prevent the grip moving to the closed position when the trigger lever is in the rearward position; and the trigger contact surface being spaced apart from the pivot element by a third distance greater than the first distance when the trigger lever is in the forward position thereby to enable the grip moving to the closed position when the trigger lever is in the forward position.

2. The pistol of claim 1 wherein the trigger has an intermediate position between the forward and rearward position, and wherein the pocket block surface is adapted to contact a portion of the trigger lever when the trigger lever is in the intermediate position thereby to prevent the grip moving to the closed position when the trigger lever is in the intermediate position.

3. The pistol of claim 2 wherein the trigger includes a sear element adapted to restrain the bolt in the cocked position when the trigger is in the intermediate position.

4. The pistol of claim 1 wherein the bolt has a home position between the rearward position and the forward position, and wherein the trigger is in the forward position when the bolt is in the home position.

5. The pistol of claim 4 wherein the bolt includes a catch element operably engaging the trigger when the trigger is in the home position to restrain the trigger in the forward position when the bolt is in the home position, except upon movement of the bolt toward the cocked position.

6. The pistol of claim 5 wherein the trigger defines a pocket receiving the catch element when the trigger is in the forward position and the bolt is in the home position.

7. The pistol of claim 4 wherein the bolt has a rear surface flush with a rear surface of the frame when the bolt is in the home position.

8. The pistol of claim 1 wherein the bolt includes a firing pin adapted to discharge a cartridge in the chamber upon movement to the battery position.

9. The pistol of claim 1 wherein the barrel includes an engagement element and bolt includes a barrel lock element adapted to engage the engagement element to restrain the barrel in the operating position when the barrel lock element engages the engagement element.

10. The pistol of claim 9 wherein the barrel lock element engages the engagement element when the bolt is in the cocked position, such that the barrel may not be moved from the operating position when the pistol is cocked.

11. The pistol of claim 1 wherein the frame and grip are each elongated elements that are parallel to each other when in the closed position and angularly disposed with each other when in the open position.

12. The pistol of claim 1 wherein the pistol defines a rectangular periphery when in the closed position.

13. The pistol of claim 1 wherein the trigger lever is entirely enclosed by the frame and the grip pocket when in the closed position.

14. The pistol of claim 1 wherein the bolt is an elongated body having a sear engagement surface at a forward end adapted to be engaged by the trigger, and has a block element at an intermediate location, and the trigger defines an opening adapted to receive the block element to prevent movement of the trigger.

15. A pistol comprising:

a frame;

a barrel connected to the frame and defining a bore and a chamber and movable between an operating position and a loading position;

a bolt connected to the frame and operable to reciprocate between a rearward cocked position and a forward battery position;

a trigger connected to the frame and having a trigger lever movable between a forward position and a rearward position;

a grip pivotally connected to the frame by way of a pivot element and the grip being pivotally movable between a closed position abutting the frame, and an open position away from the frame;

the grip defining a pocket adapted to receive the trigger lever when the trigger lever is in the forward position;

the grip having a pocket block surface spaced apart from the pivot element by a first distance;

the trigger lever having a contact surface spaced apart from the pivot element by a second distance less than the first distance when the trigger lever is in the rearward position thereby to prevent the grip moving to the closed position when the trigger lever is in the rearward position thereby to prevent the trigger lever moving to the rearward position when the grip is in the closed position.

16. The pistol of claim 15 wherein the trigger lever has an intermediate position between the forward and rearward position, and wherein the pocket block surface is adapted to contact a portion of the trigger lever when the trigger lever is in the intermediate position thereby to prevent the grip moving to the closed position when the lever is in the intermediate position.

17. The pistol of claim 16 wherein the trigger includes a sear element adapted to restrain the bolt in the cocked position when the trigger is in the intermediate position.

18. The pistol of claim 15 wherein the bolt has a home position between the rearward position and the forward position, and wherein the trigger is in the forward position when the bolt is in the home position.

19. The pistol of claim 15 wherein the trigger lever is entirely enclosed by the frame and the grip pocket when in the closed position.

20. The pistol of claim 15 wherein the bolt is an elongated body having a sear engagement surface at a forward end adapted to be engaged by the trigger, and has a block element at an intermediate location, and the trigger defines an opening adapted to receive the block element to prevent movement of the trigger.

* * * * *